US008435708B2

(12) United States Patent
Nakamura et al.

(10) Patent No.: US 8,435,708 B2
(45) Date of Patent: May 7, 2013

(54) MAGENTA TONER FOR LIGHT FIXING, DEVELOPER FOR ELECTROSTATIC IMAGE, DEVELOPER CARTRIDGE, AND IMAGE FORMING APPARATUS

(75) Inventors: Yasushige Nakamura, Kanagawa (JP); Shinichi Yaoi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 212 days.

(21) Appl. No.: 12/914,404

(22) Filed: Oct. 28, 2010

(65) Prior Publication Data

US 2011/0318684 A1 Dec. 29, 2011

(30) Foreign Application Priority Data

Jun. 23, 2010 (JP) ..... 2010-143032

(51) Int. Cl.
*G03G 9/00* (2006.01)

(52) U.S. Cl.
USPC ..... 430/108.21; 430/108.1; 430/108.23

(58) Field of Classification Search ..... 106/31.6, 106/494, 495; 430/105, 107.1, 108.1, 108.2, 430/108.21, 108.23, 108.22
See application file for complete search history.

(56) References Cited

U.S. PATENT DOCUMENTS

| | | | | |
|---|---|---|---|---|
| 7,083,887 | B2 | 8/2006 | Nakamura et al. | |
| 7,087,353 | B2 | 8/2006 | Mikuriya et al. | |
| 7,166,158 | B2 | 1/2007 | Mitina et al. | |
| 7,416,826 | B2 | 8/2008 | Nakamura et al. | |
| 2003/0203304 | A1 * | 10/2003 | Katagiri et al. | 430/124 |
| 2005/0011403 | A1 * | 1/2005 | Mitina et al. | 106/31.6 |

FOREIGN PATENT DOCUMENTS

| | | |
|---|---|---|
| JP | A-5-100472 | 4/1993 |
| JP | A-2000-352835 | 12/2000 |
| JP | A-2003-270860 | 9/2003 |
| JP | A-2004-138727 | 5/2004 |
| JP | A-2004-170957 | 6/2004 |
| JP | A-2007-500254 | 1/2007 |

* cited by examiner

*Primary Examiner* — Stewart Fraser
(74) *Attorney, Agent, or Firm* — Oliff & Berridge, PLC

CHANGE OF ABSORBANCE CHARACTERISTICS ON REDUCTION OF ONIUM COMPOUND

(57) ABSTRACT

A magenta toner contains a binder resin; at least one selected from a diimonium compound represented by the following general formula (1) and an aminium compound represented by the following general formula (2); and a monomethylquinacridone:

(1)

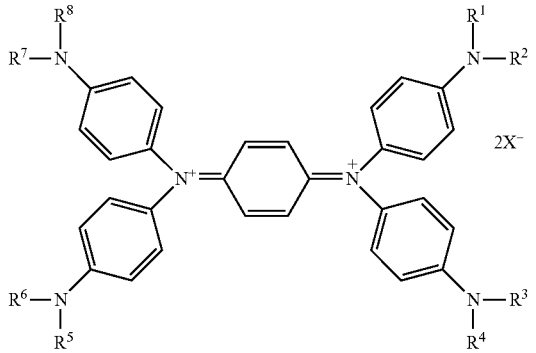

-continued (2)

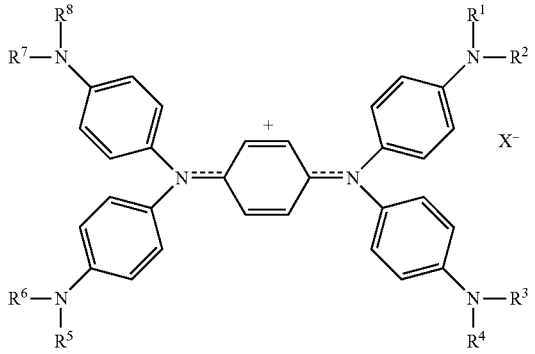

where in the general formulae (1) and (2), $R^1$, $R^2$, $R^3$, $R^4$, $R^5$, $R^6$, $R^7$ and $R^8$ each independently represent a hydrogen atom, an unsubstituted or substituted and linear alkyl group, an unsubstituted or substituted and branched alkyl group, an unsubstituted or substituted and cyclic alkyl group, an unsubstituted or substituted and linear alkenyl group, an unsubstituted or substituted and branched alkenyl group, an unsubstituted or substituted and cyclic alkenyl group, or an unsubstituted or substituted aralkyl group; and $X^-$represents an anion.

13 Claims, 2 Drawing Sheets

MAGENTA TONER FOR LIGHT FIXING, DEVELOPER FOR ELECTROSTATIC IMAGE, DEVELOPER CARTRIDGE, AND IMAGE FORMING APPARATUS

CROSS-REFERENCE TO RELATED APPLICATIONS

This application is based on and claims priority under 35 USC 119 from Japanese Patent Application No. 2010-143032 filed Jun. 23, 2010.

BACKGROUND

1. Technical Field

The present invention relates to a magenta toner for light fixing, a developer for an electrostatic image, a developer cartridge, and an image forming apparatus.

2. Related Art

In an electrophotographic system, which is widely spread in various fields including a copier, a printer and a printing machine, examples of a fixing method of fixing a toner image having been transferred to a recording medium includes a method of fusing the toner with pressure, heat or combination thereof and then solidifying and fixing the toner, and a method of fusing the toner with heat energy converted from irradiated light energy and then solidifying and fixing the toner. Among these methods, the light fixing method is receiving attention. Examples of the light fixing method include a flash light fixing method using a xenon lamp, and a laser light fixing method using an emission diode or a high-intensity laser.

SUMMARY

According to an aspect of the invention, there is provided a magenta toner for light fixing including: a binder resin; at least one selected from a diimonium compound represented by the following general formula (1) and an aminium compound represented by the following general formula (2); and a monomethylquinacridone:

(1)

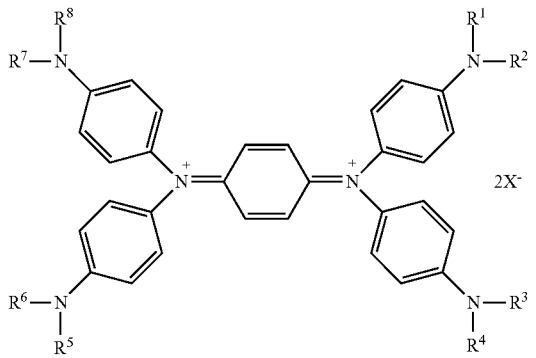

-continued (2)

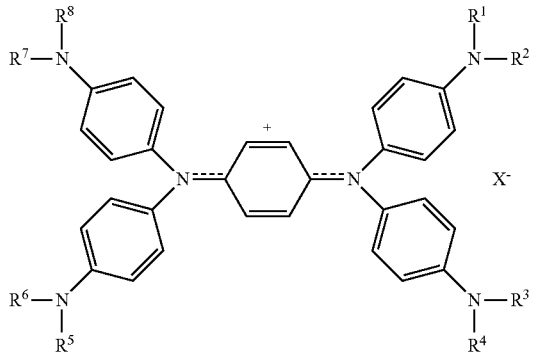

In the general formulae (1) and (2), $R^1$, $R^2$, $R^3$, $R^4$, $R^5$, $R^6$, $R^7$ and $R^8$ each independently represent a hydrogen atom, an unsubstituted or substituted and linear alkyl group, an unsubstituted or substituted and branched alkyl group, an unsubstituted or substituted and cyclic alkyl group, an unsubstituted or substituted and linear alkenyl group, an unsubstituted or substituted and branched alkenyl group, an unsubstituted or substituted and cyclic alkenyl group, or an unsubstituted or substituted aralkyl group; and $X^-$ represents an anion.

BRIEF DESCRIPTION OF THE DRAWINGS

Exemplary embodiment of the present invention will be described in detail based on the following figures, wherein.

DETAILED DESCRIPTION

Figure 1:
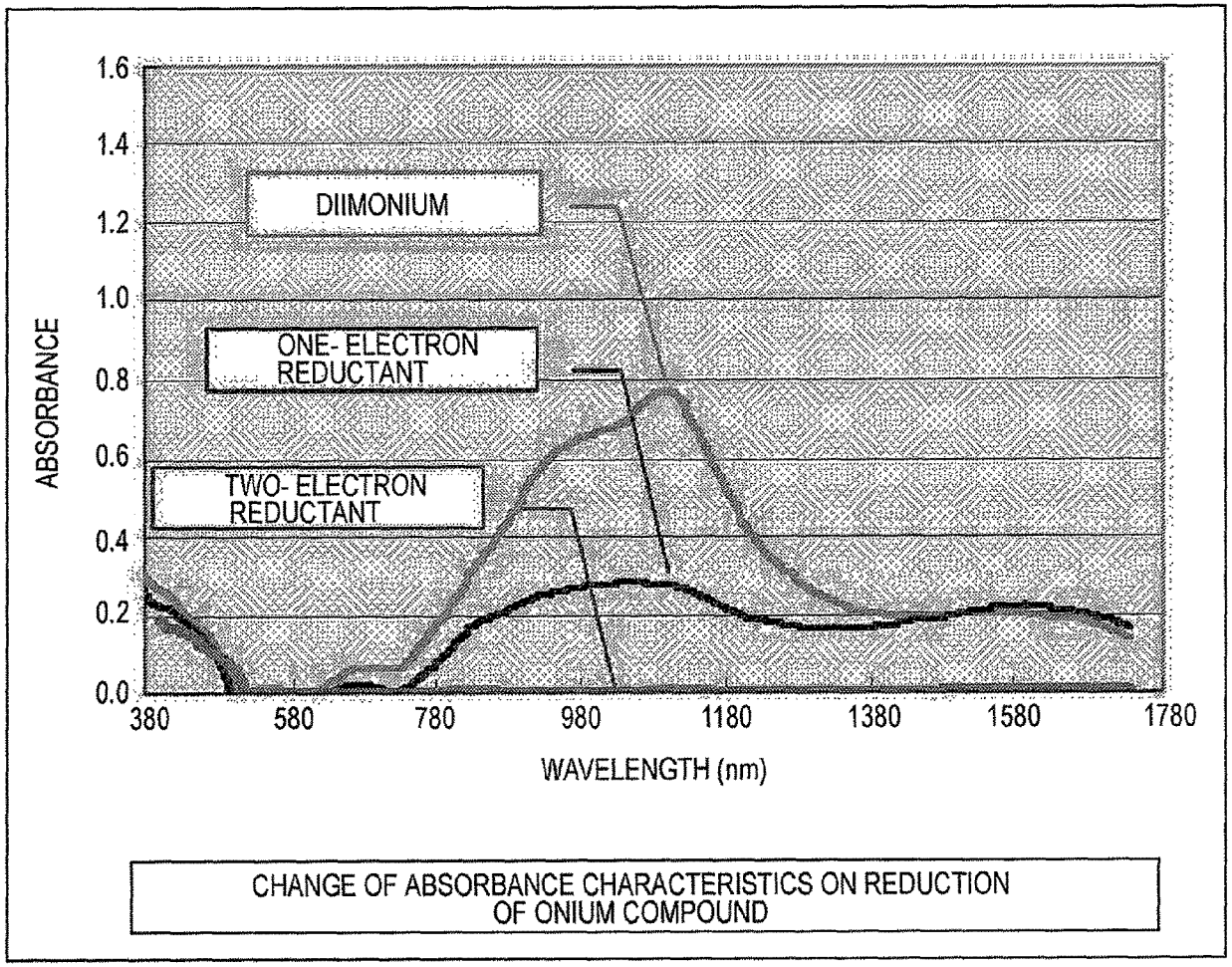
FIG. 1 is a graph showing absorbance around the infrared region of the diimonium compound represented by the general formula (1) and a one-electron reductant and a two-electron reductant of the compound represented by the general formula (1)

Exemplary embodiments of the invention will be described in detail below.

Magenta Toner for Light Fixing

The magenta toner for light fixing according to an exemplary embodiment of the invention (which may be hereinafter referred simply to as a toner) contains a binder resin, at least one selected from a diimonium compound represented by the following general formula (1) and an aminium compound represented by the following general formula (2), and a monomethylquinacridone:

(1)

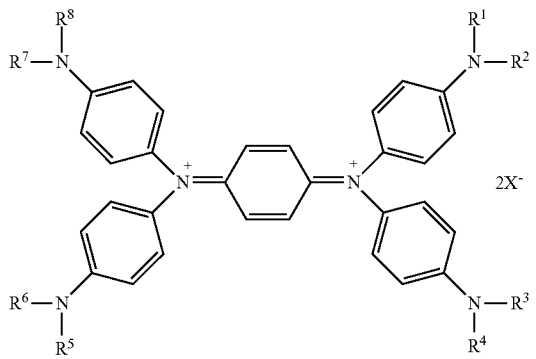

-continued (2)

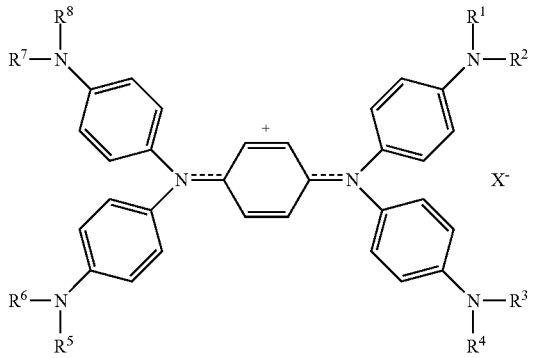

In the general formulae (1) and (2), $R^1$, $R^2$, $R^3$, $R^4$, $R^5$, $R^6$, $R^7$ and $R^8$ each independently represent a hydrogen atom, an unsubstituted or substituted and linear alkyl group, an unsubstituted or substituted and branched alkyl group, an unsubstituted or substituted and cyclic alkyl group, an unsubstituted or substituted and linear alkenyl group, an unsubstituted or substituted and branched alkenyl group, an unsubstituted or substituted and cyclic alkenyl group, or an unsubstituted or substituted aralkyl group; and $X^-$ represents an anion.

The aminium compound represented by the general formula (2) is a substance corresponding to a one-electron reductant of the diimonium compound represented by the general formula (1). Upon further reducing the aminium compound represented by the general formula (2), a two-electron reductant represented by the following general formula (3) is formed.

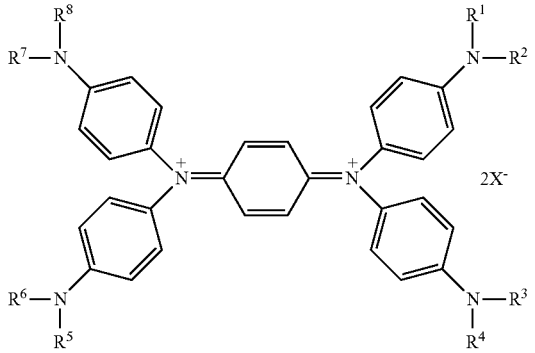

(1)

-continued

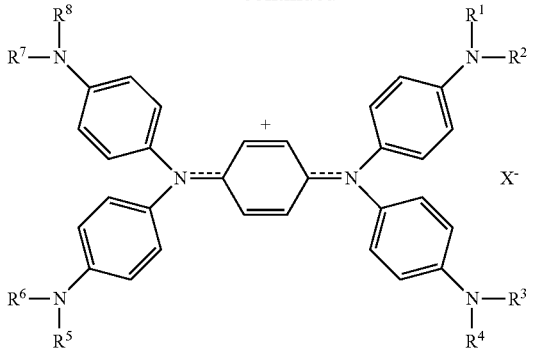

(2)

one-electron reductant

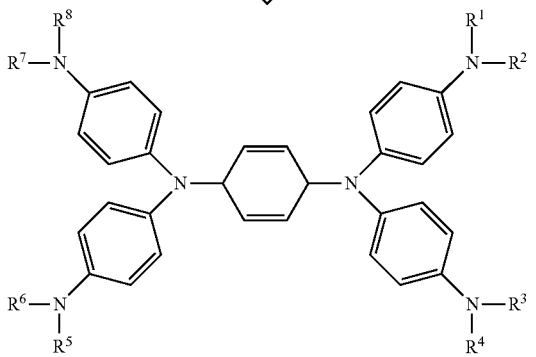

(3)

two-electron reductant

The capability as an infrared ray absorbent, i.e., the absorbance in the near infrared region, is high for the diimonium compound represented by the general formula (1) and is the second for the aminium compound represented by the general formula (2), and the two-electron reductant represented by the general formula (3) exhibits substantially no infrared ray absorbability.

The diimonium compound represented by the general formula (1) exhibiting excellent infrared ray absorbability is colored navy blue by itself, and the aminium compound represented by the general formula (2) is colored green. The two-electron reductant is substantially not colored and is colorless or lightly yellowed. Accordingly, the diimonium compound represented by the general formula (1) or the aminium compound represented by the general formula (2) exerts the function of an infrared ray absorbent before light fixing, and after light fixing, is discolored through reduction to the colorless or lightly yellowed compound represented by the general formula (3). Therefore, the infrared ray absorbent added to the toner does not affect the color tone of the fixed image.

The toner according to the exemplary embodiment contains the easily reducible compound as an infrared ray absorbent, and therefore, is designed to prevent the infrared ray absorbent from being reduced before light fixing.

It has been found herein that a yellow toner and a cyan toner are enhanced in light absorbability corresponding to the amount of the infrared ray absorbent added to the toners, but in a magenta toner, the diimonium compound or the aminium compound as an infrared ray absorbent is reduced through reaction with a magenta pigment, thereby failing to exert sufficient light absorbability, and consequently, sufficient fixing property may not be obtained.

Under the circumstances, in the exemplary embodiment, a magenta pigment that has strong reducing power to the diimonium compound or the aminium compound is not added, but a monomethylquinacridone is used as a magenta pigment. It has been found that the monomethylquinacridone hardly reduces the diimonium compound represented by the general formula (1) or the aminium compound represented by the general formula (2). Accordingly, the combination use of the diimonium compound represented by the general formula (1) or the aminium compound represented by the general formula (2) as an infrared ray absorbent and the monomethylquinacridone as a magenta pigment provides a magenta toner for light fixing that is not lowered in light fixing property.

In the exemplary embodiment, the ratio by mass of the at least one selected from the diimonium compound and the aminium compound to the monomethylquinacridone may be from 5/3 or approximately 5/3 to 1/70 or approximately 1/70, and preferably from 1/1 or approximately 1/1 to 1/5 or approximately 1/5.

The magenta toner for light fixing according to the exemplary embodiment will be described in detail below.

Infrared Ray Absorbent

The infrared ray absorbent in the exemplary embodiment is at least one selected from the diimonium compound represented by the general formula (1) and the aminium compound represented by the general formula (2).

(1)

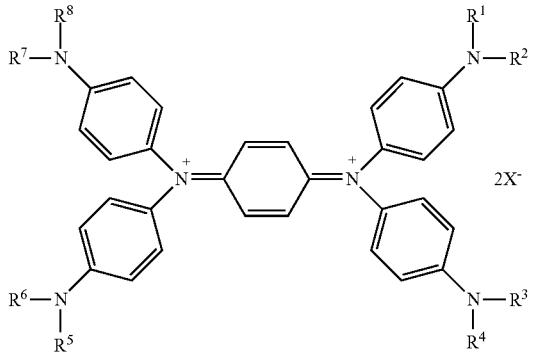

(2)

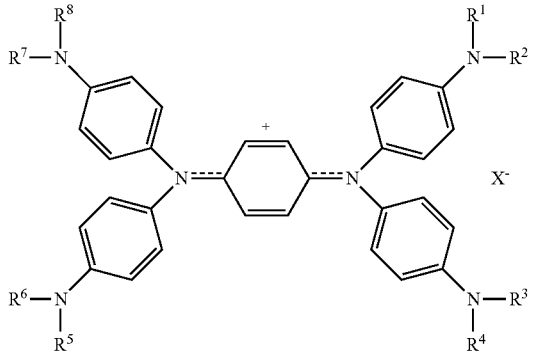

In the general formulae (1) and (2), $R^1$, $R^2$, $R^3$, $R^4$, $R^5$, $R^6$, $R^7$ and $R^8$ each independently represent a hydrogen atom, an unsubstituted or substituted and linear alkyl group, an unsubstituted or substituted and branched alkyl group, an unsubstituted or substituted and cyclic alkyl group, an unsubstituted or substituted and linear alkenyl group, an unsubstituted or substituted and branched alkenyl group, an unsubstituted or substituted and cyclic alkenyl group, or an unsubstituted or substituted aralkyl group; and $X^-$ represents an anion.

The alkyl groups represented by $R^1$, $R^2$, $R^3$, $R^4$, $R^5$, $R^6$, $R^7$ and $R^8$ each may be an alkyl group having from 1 to 10 carbon atoms, preferably an alkyl group having from 2 to 7 carbon atoms, and more preferably an alkyl group having from 3 to 4 carbon atoms.

The alkyl groups represented by $R^1$, $R^2$, $R^3$, $R^4$, $R^5$, $R^6$, $R^7$ and $R^8$ each may be an unsubstituted alkyl group and each may be a linear or branched alkyl group.

The alkenyl groups represented by $R^1$, $R^2$, $R^3$, $R^4$, $R^5$, $R^6$, $R^7$ and $R^8$ each may be an alkenyl group having from 2 to 10 carbon atoms, preferably an alkenyl group having from 2 to 7 carbon atoms, and more preferably an alkenyl group having from 3 to 4 carbon atoms.

The alkenyl groups represented by $R^1$, $R^2$, $R^3$, $R^4$, $R^5$, $R^6$, $R^7$ and $R^8$ each may be an unsubstituted alkenyl group and each may be a linear or branched alkenyl group.

The aralkyl groups represented by $R^1$, $R^2$, $R^3$, $R^4$, $R^5$, $R^6$, $R^7$ and $R^8$ each may be an aralkyl group having from 7 to 10 carbon atoms.

The aralkyl groups represented by $R^1$, $R^2$, $R^3$, $R^4$, $R^5$, $R^6$, $R^7$ and $R^8$ each may be an unsubstituted aralkyl group.

Among these, $R^1$, $R^2$, $R^3$, $R^4$, $R^5$, $R^6$, $R^7$ and $R^8$ each may represent a hydrogen atom, an unsubstituted or substituted and linear alkyl group, an unsubstituted or substituted and branched alkyl group or an unsubstituted or substituted and cyclic alkyl group, preferably a hydrogen atom, an unsubstituted and linear alkyl group or an unsubstituted and branched alkyl group, more preferably an unsubstituted and linear alkyl group or an unsubstituted and branched alkyl group, and further preferably a n-butyl group, an iso-butyl group or a n-propyl group.

Examples of the anion represented by $X^-$ include a perchlorate ion ($ClO_4^-$), a fluoroborate ion ($BF_4^-$) a trichloroacetate ion ($CCl_3COO^-$), a trifluoroacetate ion ($CF_3COO^-$), a picrate ion ($(NO_2)_3C_6H_2O^-$), a hexafluoroarsenate ion ($AsF_6^-$), a hexafluoroantimonate ion ($SbF_6^-$), a benzenesulfonate ion ($C_6H_5SO_3^-$), an ethanesulfonate ion ($C_2H_5SO_3^-$), a phosphate ion ($PO_4^{2-}$), a sulfate ion ($SO_4^{2-}$), a chlorine ion ($Cl^-$), an iodine ion ($I^-$), a trifluoromethanesulfonate ion ($CF_3SO_3^-$), a trifluoromethanesulfonic imide ion ($(CF_3SO_2)_2N^-$), a hexafluorophosphate ion ($PF_6^-$), $C(SO_2CF_3)_3^-$ and a nitrate ion ($NO_3^-$).

Among these, the anion represented by $X^-$ may be a trifluoromethanesulfonate ion or a trifluoromethanesulfonic imide ion, whereby the infrared ray absorbability may be prevented from being lowered.

The infrared ray absorbent may be the diimonium compound represented by the general formula (1) from the standpoint of absorbability in the infrared region. The infrared ray absorbent used may be a combination of the compound represented by the general formula (1) and the compound represented by the general formula (2), or may be the compound represented by the general formula (2) solely.

In addition to the infrared ray absorbents represented by the general formulae (1) and (2), a known infrared ray absorbent may be used in combination therewith in the magenta toner for light fixing of the exemplary embodiment. The infrared ray absorbent referred herein is a material that has at least one strong light absorption peak measured with a spectrophotometer or the like in the near infrared region having a wavelength of from 800 to 1,200 nm, and may be an organic material or an inorganic material.

Specific examples of the infrared ray absorbent used in combination include a cyanine compound, a merocyanine compound, a benzenthiol metallic complex, a mercaptophenol metallic complex, an aromatic diamine metallic complex, a nickel complex compound, a phthalocyanine compound, an anthraquinone compound, a naphthalocyanine compound and a croconium compound.

Among these infrared ray absorbents, a naphthalocyanine compound and a croconium compound may be used.

The amount of the infrared ray absorbent added may be from approximately 0.05% to approximately 10% by mass, preferably from approximately 0.1% to approximately 5% by mass, and more preferably from approximately 0.2% to approximately 3% by mass, based on the magenta toner for light fixing.

Binder Resin

The binder resin used in the exemplary embodiment may be a known binder resin. Examples of a component constituting the binder resin include a copolymer of styrene and acrylic acid or methacrylic acid, a polyvinyl chloride, a phenol resin, an acrylate resin, a methacrylate resin, a polyvinyl acetate, a silicone resin, a polyester resin, a polyolefin resin, a polyurethane resin, a polyimide resin, a furan resin, an epoxy resin, a xylene resin, a polyvinyl butyral resin, a terpene resin, a coumarone-indene resin, a petroleum resin and a polyether polyol resin, which may be used solely or as a combination thereof.

A polyester resin or a polyolefin resin may be used, and a polyester resin or a norbornene polyolefin resin are preferably used, from the standpoint of durability, light transmittance and the like.

A polyester resin that may be used in the exemplary embodiment will be described in more detail. Examples of the acid component constituting the polyester resin include a terephthalic acid, isophthalic acid, orthophthalic acid and anhydrides thereof, and among these terephthalic acid and isophthalic acid may be used. The acid component may be used solely or as a mixture of two or more kinds thereof. An additional acid component other than these acid components may be used in such an amount that no problematic odor occurs upon light fixing. Examples of the additional acid component include maleic acid, fumaric acid, citraconic acid, itaconic acid, glutaconic acid, cyclohexanedicarboxylic acid, succinic acid, adipic acid, sebacic acid, azelaic acid and malonic acid, and also include an alkyl- or alkenylsuccinic acid, such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid and isododecenylsuccinic acid, anhydrides thereof, a lower alkyl ester, and other dibasic carboxylic acid. A trivalent or higher carboxylic acid component may be used in combination for crosslinking the polyester resin. Examples of the trivalent or higher carboxylic acid component include 1,2,4-benzenetricarboxylic acid, 1,3,5-benzenetricarboxylic acid, other polycarboxylic acids, and anhydrides thereof.

In the polyester resin, the alcohol component is generally constituted by a bisphenol A alkylene oxide adduct in an amount of 80% by mol or more, preferably 90% by mol or more, and more preferably 95% by mol or more.

Examples of the bisphenol A alkylene oxide adduct include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydoxyphenyl)propane. These compounds may be used solely or as a mixture of two or more kinds thereof.

In the polyester resin used as the binder resin in the exemplary embodiment, an additional alcohol component may be used in combination with the aforementioned alcohol components depending on necessity. Examples of the additional alcohol component include a diol compound, such as ethylene glycol, diethylene glycol, triethylene glycol, 1,2-propylene glycol, 1,3-propylene glycol, 1,4-butanediol, neopentyl glycol, 1,4-butenediol, 1,5-pentane diol and 1,6-hexanediol, and other dihydric alcohol, such as bisphenol A and hydrogenated bisphenol A.

A trihydric or higher alcohol may also be used as the additional alcohol component. Examples of the alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and other trihydric or higher alcohols.

In reaction for synthesizing the polyester resin, an esterification catalyst that is ordinarily employed, such as zinc oxide, stannous oxide, dibutyltin oxide, dibutyltin dilaurate and titanium, may be used for promoting the reaction. A titanium compound is suitable for light fixing since good color reproducibility may be obtained.

The binder resin used in the toner may have a glass transition temperature Tg of from approximately 50° C. to approximately 70° C.

Colorant

A monomethylquinacridone is used as a colorant to prepare a magenta toner.

In the magenta toner, it is considered that the difference in properties of the monomethylquinacridone from an unsubstituted quinacridone and a dimethylquinacridone resides in that the monomethylquinacridone is an asymmetric molecule to form a crystalline structure that is different therefrom, i.e., the difference in reactivity due to crystalline system.

The monomethylquinacridone in the exemplary embodiment may be a monomethylquinacridone represented by the following general formula (4).

(4)

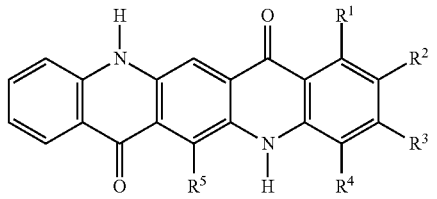

In the general formula (4), one of $R^1$, $R^2$, $R^3$, $R^4$ and $R^5$ represents a methyl group, and the others thereof each represent a hydrogen atom. The presence of one methyl group makes the quinacridone compound asymmetric, thereby providing difference in reactivity due to crystalline system. One of and $R^1$, $R^2$, $R^3$ and $R^4$ may be a methyl group, and it is preferred that $R^2$ represents a methyl group, i.e., the monomethylquinacridone having the following structural formula (1).

(1)

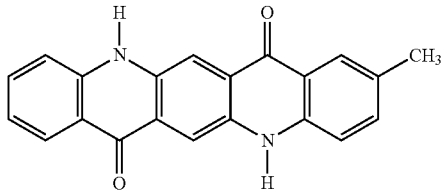

A mixed crystal of the monomethylquinacridone with an unsubstituted quinacridone and a dimethylquinacridone provides the same crystalline structure as that of the monomethylquinacridone, thereby providing the same effects as in the case using the monomethylquinacridone solely. As the mixed crystal of the monomethylquinacridone with an unsubstituted quinacridone and a dimethylquinacridone, a solid solution containing the following three compounds of the structural formulae (1), (2) and (3) may be used.

(1)

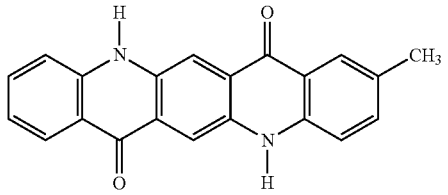

(2)

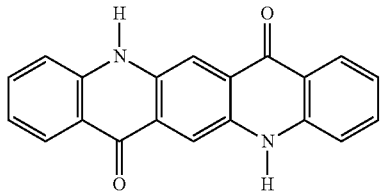

(3)

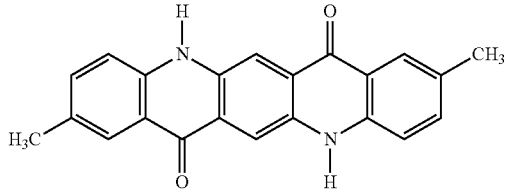

In the case where the monomethylquinacridone is used as the solid solution with an unsubstituted quinacridone and a dimethylquinacridone, the content of the monomethylquinacridone in the solid solution may be approximately 4% by mass or more, preferably 25% or approximately 25% by mass or more, and more preferably approximately 45% by mass or more.

A solid solution is defined as a homogeneous mixture in a solid state of two or more kinds of the components and is different from a physical mixture of the compounds. The X-ray diffraction pattern of the resulting solid solution may be clearly distinguished from the pattern of the physical mixture containing the same components at the same ratio. In the physical mixture, the X-ray diffraction patterns of each of the components can be discriminated from each other, and one of the criteria for determining the formation of a solid solution is extinction of the patterns of the components. A solid solution is also referred to as a mixed crystal.

The solid solution of the monomethylquinacridone with an unsubstituted quinacridone and a dimethylquinacridone may be obtained in a manner shown in examples described later. Specifically, dimethyl succinylo succinate (methyl 1,4-cyclohexandione-2,5-dicarboxylate), p-toluidine and aniline as starting materials are reacted to provide the solid solution. The content of the monomethylquinacridone in the solid solution may be controlled by changing the mixing ratio of p-toluidine and aniline.

It may be determined as to whether or not the solid solution of the monomethylquinacridone with an unsubstituted quinacridone and a dimethylquinacridone is in the form of a solid solution but not a simple mixture, by the X-ray diffraction pattern as described above.

The amount of the monomethylquinacridone added (which is the total amount of the solid solution added in the case where the monomethylquinacridone is used as the solid solution) may be from approximately 2% to approximately 15% by mass, and preferably from approximately 3% to approximately 7% by mass, based on the amount of the final magenta toner particles produced after mixing with the binder resin and the other components.

An additional colorant may be used in combination for controlling the color gamut in an amount of approximately 2% or below by mass based on the total amount of the colorants. Examples of the additional colorant include magenta pigments, such as C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 13, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 39, C.I. Pigment Red 40, C.I. Pigment Red 41, C.I. Pigment Red 48, C.I. Pigment Red 49, C.I. Pigment Red 51, C.I. Pigment Red 52, C.I. Pigment Red 53, C.I. Pigment Red 54, C.I. Pigment Red 55, C.I. Pigment Red 57, C.I. Pigment Red 58, C.I. Pigment Red 60, C.I. Pigment Red 63, C.I. Pigment Red 64, C.I. Pigment Red 68, C.I. Pigment Red 81, C.I. Pigment Red 83, C.I. Pigment Red 87, C.I. Pigment Red 88, C.I. Pigment Red 89, C.I. Pigment Red 90, C.I. Pigment Red 112, C.I. Pigment Red 114, C.I. Pigment Red 122, C.I. Pigment Red 123, C.I. Pigment Red 163, C.I. Pigment Red 184, C.I. Pigment Red 202, C.I. Pigment Red 206, C.I. Pigment Red 207, C.I. Pigment Red 209 and the like, a magenta pigment of Pigment Violet 19, C.I. Solvent Red 1, C.I. Solvent Red 3, C.I. Solvent Red 8, C.I. Solvent Red 23, C.I. Solvent Red 24, C.I. Solvent Red 25, C.I. Solvent Red 27, C.I. Solvent Red 30, C.I. Solvent Red 49, C.I. Solvent Red 81, C.I. Solvent Red 82, C.I. Solvent Red 83, C.I. Solvent Red 84, C.I. Solvent Red 100, C.I. Solvent Red 109, C.I. Solvent Red 121, C.I. Disperse Red 9, C.I. Basic Red 1, C.I. Basic Red 2, C.I. Basic Red 9, C.I. Basic Red 12, C.I. Basic Red 13, C.I. Basic Red 14, C.I. Basic Red 15, C.I. Basic Red 17, C.I. Basic Red 18, C.I. Basic Red 22, C.I. Basic Red 23, C.I. Basic Red 24, C.I. Basic Red 27, C.I. Basic Red 29, C.I. Basic Red 32, C.I. Basic Red 34, C.I. Basic Red 35, C.I. Basic Red 36, C.1. Basic Red 37, C.I. Basic Red 38, C.I. Basic Red 39 and C.I. Basic Red 40, Red Iron Oxide, Cadmium Red, red lead, mercury sulfide, cadmium, Permanent Red 4R, Lithol Red, Pyrazolone Red, Watchung Red, a calcium salt, Lake Red D, Brilliant Carmine 6B, Eosin Lake, Rhodamine Lake B, Alizarine Lake and Brilliant Carmine 3B.

Other Components

The magenta toner for light fixing of the exemplary embodiment may contain a charge controlling agent and wax depending on necessity.

Examples of the charge controlling agent include known materials, such as calixarene, a nigrosine dye, a quaternary ammonium salt, an amino group-containing polymer, a metal-containing azo dye, a complex compound of salicylic acid, a phenol compound, an azochromium compound and an azozinc compound.

The magenta toner for light fixing may be a magnetic toner containing a magnetic material, such as iron powder, magnetite and ferrite. Known white magnetic powder (produced, for example, by Nittetsu Mining Co., Ltd.) may be used.

Examples of the wax to be contained in the magenta toner for light fixing of the exemplary embodiment include ester wax, polyethylene, polypropylene, and a copolymer of polyethylene and polypropylene, and also include polyglycerin wax, microcrystalline wax, paraffin wax, carnauba wax, sasol wax, montanate ester wax, deoxidized carnauba wax; an unsaturated fatty acid, such as palmitic acid, stearic acid, montanic acid, brandinic acid, eleostearic acid and parinaric acid, a saturated alcohol, such as stearyl alcohol, aralkyl alcohol, behenyl alcohol, carnaubyl alcohol, ceryl alcohol, melissyl alcohol and a long-chain alkyl alcohol having a long-chain alkyl group; a polyhydric alcohol, such as sorbitol; a fatty acid amide, such as linoleic amide, oleic amide and lauric amide; a saturated fatty acid bisamide, such as methylene bisstearic amide, ethylene biscapric amide, ethylene bislauric amide and hexamethylene bisstearic amide; an unsaturated fatty acid amide, such as ethylene bisoleic amide, hexamethylene bisoleic amide, N,N'-dioleyladipic amide and N,N'-dioleylsebacic amide; an aromatic bisamide, such as m-xylene bisstearic amide and N,N'-distearylisophthalic amide; a fatty acid metallic salt (which is ordinarily referred to as a metallic soap), such as calcium stearate, calcium laurate, zinc stearate and magnesium stearate; wax formed by grafting a vinyl monomer, such as styrene and acrylic acid, to aliphatic hydrocarbon wax; a partial esterification product of a fatty acid and a polyhydric alcohol, such as behenic acid monoglyceride; and a methyl ester compound having a hydroxyl group formed by hydrogenation of a vegetable fat or oil.

The wax may be used solely or as a combination of two or more kinds thereof. The amount of the wax added in the exemplary embodiment may be from approximately 0.1% to approximately 10% by mass, and preferably approximately 1% to approximately 4% by mass, based on the amount of the toner particles finally produced.

Production Method of Magenta Toner for Light Fixing

Upon producing the magenta toner for light fixing of the exemplary embodiment, a method that is ordinarily employed, such as a kneading and pulverization method and a wet granulation method, may be employed. Examples of the wet granulation method include a suspension polymerization method, an emulsion polymerization method, an emulsion polymerization and aggregation method, a soap free emulsion polymerization method, a nonaqueous dispersion polymerization method, in-situ polymerization method, an interface polymerization method and an emulsion dispersion granulation method.

The magenta toner for light fixing of the exemplary embodiment may be produced by the kneading and pulverization method basically in such a manner that includes: mixing at least one infrared ray absorbent selected from the compounds represented by the general formula (1) and the general formula (2), the monomethylquinacridone and the like, thereby providing a toner composition; melting and kneading the toner composition (a heating step), and after cooling, pulverizing the composition, thereby providing toner particles (a kneading and pulverizing step).

In the kneading and pulverization method, the binder resin, at least one infrared ray absorbent selected from the compounds represented by the general formula (1) and the general formula (2), the monomethylquinacridone pigment as a colorant, and other additives including the wax and the charge controlling agent are sufficiently mixed with a mixing device, such as a Henschel mixer or a ball mill, and melted and kneaded with a heat kneader, such as a heating roller, a kneader or an extruder, thereby providing a toner composition containing the resins dissolved in each other, which is then cooled and solidified, pulverized and then classified to provide toner mother particles.

Toner Particles

The toner particles obtained in the aforementioned method may have a volume average particle diameter $D_{50v}$ of from approximately 3 μm to approximately 15 μm, and preferably from approximately 3 μm to approximately 10 μm.

The magenta toner for light fixing of the exemplary embodiment may contain white inorganic particles mixed with the toner particles, for example, for enhancing the flowability. The amount of the white inorganic particles mixed with the toner particles may be from approximately 0.01 to approximately 5 parts by mass, and preferably from approximately 0.01 to approximately 2.0 parts by mass, per 100 parts by mass of the toner particles.

Examples of the inorganic particles include silica, alumina, titanium oxide, barium titanate, magnesium titanate, calcium titanate, strontium titanate, zinc oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide and silicon nitride, and among these silica particles may be preferably used. Particles of a known material, such as silica, titanium, a resin and alumina, may be used in combination. Powder of a metallic salt of a higher fatty acid, such as zinc stearate, or a fluorine polymer may be contained as a cleaning aid.

The inorganic particles and, depending on necessity, desired additives are sufficiently mixed therewith with a mixing device, such as a Henschel mixer, thereby providing the magenta toner for light fixing of the exemplary embodiment.

Developer for Electrostatic Image

A developer for an electrostatic image containing the magenta toner for light fixing of the exemplary embodiment (which may be hereinafter referred simply to as a developer) may be a one-component developer constituted by the toner particles or a two-component developer containing a carrier and the toner.

Examples of the carrier for the two-component developer include a resin coated carrier containing a core material having coated on the surface thereof a resin coating layer. Examples of the core material include known materials, such as magnetite, ferrite and iron powder. The coating material of the carrier is not particularly limited, and a silicone resin may be used.

The carrier may have an average particle diameter of from approximately 10 μm to approximately 100 μm, and preferably from approximately 20 μm to approximately 80 μm.

The two-component developer may have a mixing ratio of the toner and the carrier (toner/carrier by mass) of from approximately 1/100 to approximately 30/100, and preferably from approximately 3/100 to approximately 20/100.

Magenta Color Image Forming Apparatus

A color image forming apparatus according to the exemplary embodiment contains at least a toner image forming portion that forms a color toner image with the magenta toner for light fixing on a recording medium, and a light fixing portion that fixes the toner image to the recording medium by flashing light to the toner image. Examples of the light fixing portion include flash light, laser and LED.

Toner Image Forming Portion

In the case where a color toner image is formed on a recording medium by using an electrophotographic photoconductor as the electrostatic latent image holding member, the color toner image may be formed, for example, in the following manner.

The surface of the electrophotographic photoconductor is charged with a corotron charging device, a contact charging device or the like, and then exposed to form an electrostatic image. The electrophotographic photoconductor is then made in contact with or close to a developing roller having a developer layer formed on the surface thereof, to attach the toner to the electrostatic latent image, thereby forming a toner image on the electrophotographic photoconductor. The toner image thus formed is transferred to the surface of the recording medium, such as paper, with a corotron charging device or the like. The toner image thus transferred to the surface of the recording medium is then fixed by a fixing device to form an image on the recording medium.

Examples of the electrophotographic photoconductor used generally include an inorganic photoconductor, such as amorphous silicon and selenium, and an organic photoconductor using polysilane, phthalocyanine and the like as a charge generating material and a charge transporting material, and an amorphous silicon photoconductor may be preferably used owing to the long service life thereof.

Light Fixing Portion

The light fixing portion may perform fixation with light, and in the case where the magenta toner for light fixing of the exemplary embodiment is used, a light fixing device (a flash fixing device) may be used.

Examples of the light source used in the light fixing device include ordinary light sources, such as a halogen lamp, a mercury lamp, a flash lamp and an infrared laser, and a flash lamp may be preferably used since an image may be fixed instantaneously to reduce the energy consumed. The flash lamp may have a light emission energy of from approximately 1.0 J/cm$^2$ to approximately 7.0 J/cm$^2$, and preferably from approximately 2 J/cm$^2$ to approximately 5 J/cm$^2$.

The light emission energy per unit area of flash light showing the intensity of a xenon lamp is shown by the following expression (1).

$$S=((1/2)\times C\times V^2)/(u\times L)\times(n\times f) \quad (1)$$

In the expression (1), n represents a number of lamps that emit light at one time, f represents a lighting frequency (Hz), V represents an input voltage (V), C represents a capacity of the capacitor (F), u represents a process conveying speed (cm/sec), L represents an effective light emission width of the flash lamp (cm) (which is generally the maximum width of paper), and S represents an energy density (J/cm$^2$).

The light fixing system may be a delay system, in which plural flash lamps are made to emit light with time difference. In the delay system, plural flash lamps are arranged and are each made to emit light successively with a delay of from approximately 0.01 ms to approximately 100 ms, whereby the overlapping area is irradiated plural times. According to the delay system, the light energy is fed to the toner image by dividing into plural times but not at one time, whereby the fixing conditions are reduced to attain both void resistance and fixing property simultaneously.

In the case where the toner is irradiated with flash light plural times, the light emission energy of the flash lamp indicates the total light emission energy applied to the unit area per one time of light emission.

In the exemplary embodiment, the number of the flash lamps may be from approximately 1 to approximately 20, and preferably from approximately 2 to approximately 10. The time difference in light emission between the flash lamps may be from approximately 0.1 msec to approximately 20 msec, and preferably from approximately 1 msec to approximately 3 msec.

The light emission energy of one flash lamp per one time of light emission may be from approximately 0.1 J/cm$^2$ to approximately 1 J/cm$^2$, and preferably from approximately 0.4 J/cm$^2$ to approximately 0.8 J/cm$^2$.

Accordingly, the image forming apparatus of the exemplary embodiment contains: a latent image holding member; a charging device that charges the latent image holding member; an electrostatic latent image forming device that forms an electrostatic latent image on a surface of the charged latent image holding member; a developing device that develops the electrostatic latent image formed on the surface of the charged latent image holding member, with the magenta toner for light fixing, to form a toner image; a transfer device that transfers the toner image formed on the surface of the latent image holding member, to a recording medium; and a light fixing device that fixes the toner image transferred to the recording medium, by flashing light to the toner image.

An example of the color image forming apparatus of the exemplary embodiment is described with reference to the drawing.

Figure 2:
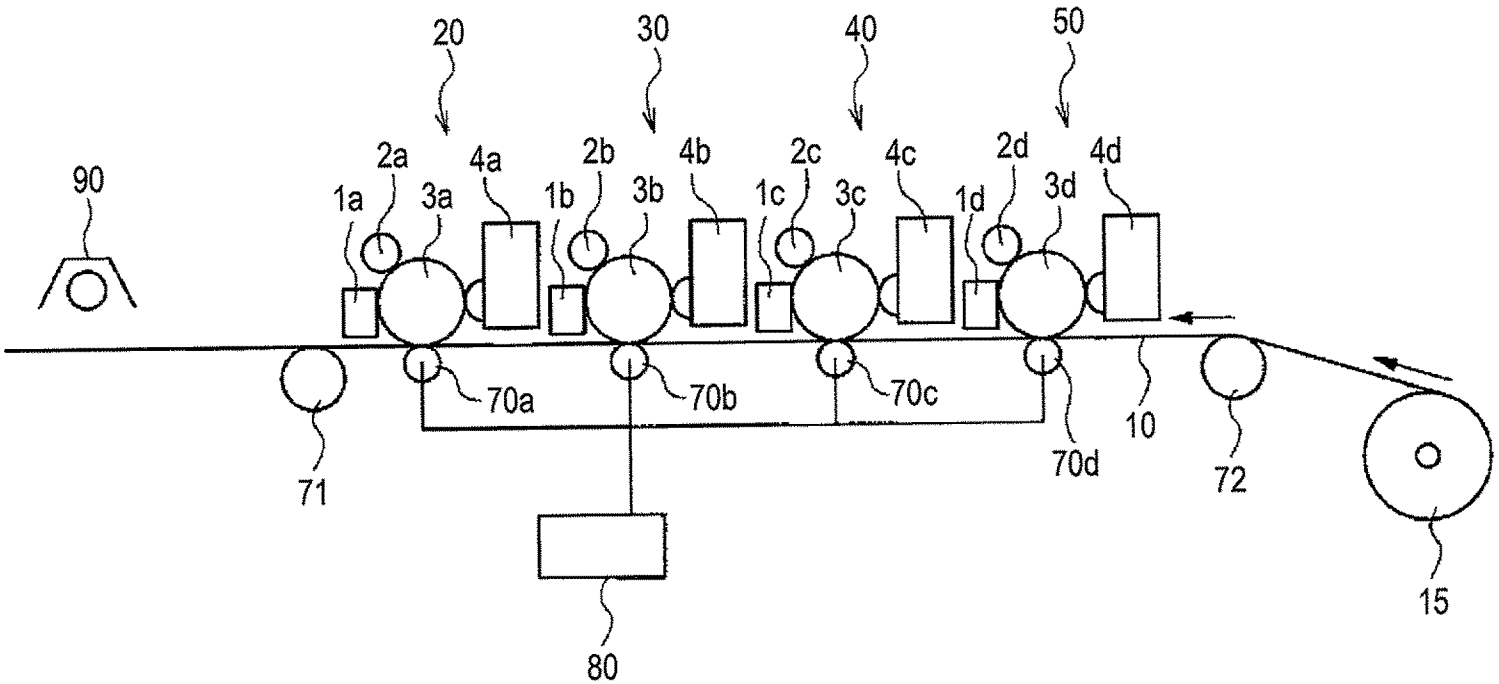
FIG. 2 is a schematic diagram showing an example of a color image forming apparatus according to an exemplary embodiment of the invention.

FIG. 2 is a schematic diagram showing an example of the color image forming apparatus of the exemplary embodiment. The color image forming apparatus shown in FIG. 2 forms a toner image with cyan, magenta, yellow and black toners.

In FIG. 2, symbols 1*a*, 1*b*, 1*c* and 1*d* each denote a charging unit, 2*a*, 2*b*, 2*c* and 2*d* each denote an exposure unit, 3*a*, 3*b*, 3*c* and 3*d* each denote an electrostatic image holding member (a photoconductor), 4*a*, 4*b*, 4*c* and 4*d* each denote a developing unit, 10 denotes a recording paper (a recording medium) that fed from a rolled medium 15 in a direction denoted by the arrows, 20 denotes a cyan image forming unit, 30 denotes a magenta image forming unit, 40 denotes a yellow image forming unit, 50 denotes a black image forming unit, 70*a*, 70*b*, 70*c* and 70*d* each denote a transfer unit (a transfer roller), 71 and 72 each denote a roller, 80 denotes a transfer voltage supplying unit, and 90 denotes a light fixing portion.

The image forming apparatus shown in FIG. 2 is constituted by: the image forming units (toner image forming unit) for each colors 20, 30, 40 and 50 that each contain a charging unit, an exposure unit, a photoconductor and a developing unit; the rollers 71 and 72 that are disposed closely to the recording paper 10 and feed the recording paper 10; the transfer rollers 70*a*, 70*b*, 70*c* and 70*d* that each are disposed to press the photoconductors of the image forming units, respectively, from the opposite side of the recording paper 10 to the photoconductors; the transfer voltage supplying unit 80 that supplies a voltage to the three transfer rollers; and the light fixing portion 90 that irradiates light to the toner image on the recording paper 10.

The cyan image forming unit 20 contains the charging unit 1*a*, the exposure unit 2*a* and the developing unit 4*a*, which are disposed clockwise in this order around the photoconductor 3*a*. The transfer roller 70*a* is disposed on the opposite side of the recording paper 10 to the photoconductor 3*a* in such a manner that the transfer roller 70*a* is in contact with the surface of the photoconductor 3*a* with the recording paper 10 intervening therebetween at the position between the position of the developing unit 4*a* and the charging unit 1*a* in the clockwise direction.

The other developing units than the cyan developing unit have the same structure as the cyan developing unit. In the image forming apparatus of the exemplary embodiment, the developing unit 4*b* of the magenta developing unit 30 houses a developer containing the magenta toner for light fixing, and the developing portions of the other developing units each house a developer containing a toner for light fixing with corresponding color, respectively.

An image forming process using the image forming apparatus is described.

In the black developing unit 50, the surface of the photoconductor 3*d* is charged with the charging unit id while rotating the photoconductor 3*d* clockwise. The charged surface of the photoconductor 3*d* is then exposed with the exposure unit 2*d*, whereby a latent image corresponding to the image of the black color component of the original image to be formed is formed on the surface of the photoconductor 3*d*. The black toner housed in the developing unit 4*d* is attached to the latent image to form a black toner image. The similar process is performed in the yellow image forming unit 40, the magenta image forming unit 30 and the cyan image forming unit 20, whereby toner images of respective colors are formed on the surfaces of the photoconductors of the developing units, respectively.

The toner images of the respective colors formed on the surfaces of the photoconductors are transferred sequentially to the recording paper 10, which is fed in the direction shown by the arrows, by the action of the transfer voltage applied to the transfer rollers 70*a*, 70*b*, 70*c* and 70*d*, and thus are superimposed on the surface of the recording paper 10 corresponding to information of the original image, thereby forming an superimposed toner image containing the cyan, magenta, yellow and black images superimposed in this order from the uppermost layer.

Upon transferring the toner image of the magenta toner, good fixing property of the toner may be obtained even when the conveying speed of the recording medium is approximately 1,000 mm/sec or more.

The superimposed toner image on the recording paper 10 is transported to the position of the light fixing portion 90 and is irradiated from the light fixing portion 90, whereby the toner image is melted and fixed to the recording paper 10 with light to form a color image.

Developer Cartridge

A developer cartridge according to the exemplary embodiment is detachable to an image forming apparatus having a light fixing portion that fixes a toner image on a surface of a recording medium by irradiating light thereto, and the developer cartridge contains the above developer for an electrostatic image.

The developer cartridge may contain at least one of the developing units 4*a*, 4*b*, 4*c* and 4*d* in the color image forming apparatus, and the image forming units 20, 30, 40 and 50 each may be the developer cartridge.

The magenta toner for light fixing of the exemplary embodiment may be applied to various purposes including newspaper, service bureau, bar-code printing, label printing, tag printing, and printers and duplicators of the Carlson process or the ion flow process, and such products can be proposed thereby that exert good light fixing property at low cost even with exemplary embodiments where a color image is formed.

EXAMPLES

The invention will be described in more detail with reference to examples below, but the invention is not limited to the examples. In the following description, the terms "part" and "%" show "part by mass" and "% by mass", respectively, unless otherwise indicated.

Preparation of Magenta Pigment 1

30 parts of well dried dimethyl succinylo succinate (methyl 1,4-cyclohexandione-2,5-dicarboxylate), 23.6 parts of p-toluidine, 300 parts of ethanol and 0.9 part of hydrochloric acid (35%) are placed in a flask equipped with a condenser and a nitrogen introducing tube, which is flashed with nitrogen gas. While the mixture is vigorously stirred, the temperature thereof is increased from room temperature to 78° C. over 15 minutes, and the mixture is reacted for 2.5 hours. The reaction mixture is cooled to a temperature of from 40 to 45° C., to which 7.08 parts of aniline is added, and the mixture is refluxed for 2.5 hours or more. The reaction mixture is cooled to 30° C. or less, and then 72 parts of a potassium hydroxide aqueous solution (50%) and 34.6 parts of sodium m-nitrobenzenesulfonate are added to the flask. The temperature of the mixture is increased to 78° C. over 15 minutes under stirring, and the mixture is reacted for 5 hours. The reaction mixture is cooled to 30° C. or less, and then filtered to remove the solid matters completely. The remaining solution is heated to a temperature of from 30 to 40° C. under stirring. 23 parts of hydrochloric acid (35%) is added dropwise thereto, and the mixture is maintained at that temperature for 30 minutes. Thereafter, the mixture is filtered, and the resulting filtered cake is rinsed with a mixture of water and methanol (1/1) and cold water and then dried to provide 48 parts of a product, which contains the following compounds (4), (5) and (6) at a ratio of 85/4/11 as confirmed from the relative peak area ratio measured by HPLC (high performance liquid chromatography).

(4)

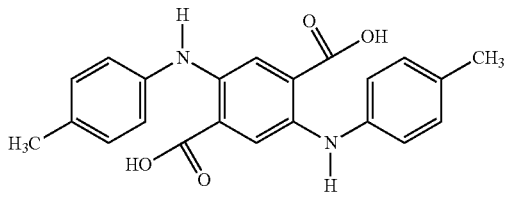

(5)

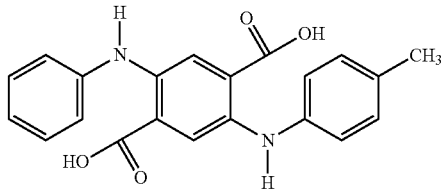

(6)

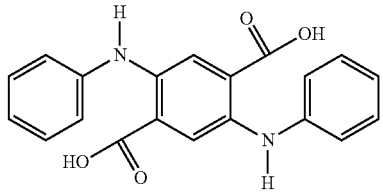

250 parts of polyphosphoric acid containing $P_2O_5$ (85.0%) is weighed in a stirring vessel. 45 parts of the product obtained above is added thereto at 90° C. under stirring, and the mixture is heated to 125° C. for 3 hours to perform ring closure reaction. The mixture is cooled to 110° C., to which parts of water is added gradually over 10 minutes. Thereafter, the mixture is poured into 750 parts of water at 50° C., and stirred at 60° C. for 1.5 hours. The solid is collected by filtering, and rinsed with water until the rinsing water becomes neutral. 100 parts of the resulting pressed cake is slurried again with 170 parts of methanol, and the slurry is heated to approximately 90° C. for 3 hours in a pressure-resistant reactor. The mixture is cooled, and the pH thereof is adjusted to 9 to 9.5 with a sodium hydroxide aqueous solution (50%). The solid matter is collected by filtering and then rinsed with water. The resulting wet pressed cake is dried in an oven and then is used as it is. Upon drying at 80° C. in an oven, approximately 19 parts of a solid solution is obtained, which contains the following compounds (7), (8) and (9) at a ratio of 85/5/10 as confirmed from the relative peak area ratio measured by HPLC.

(7)

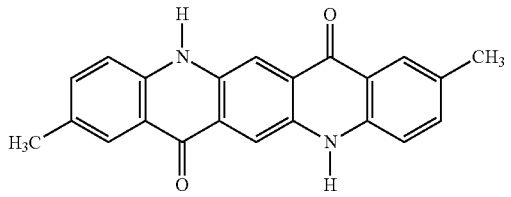

(8)

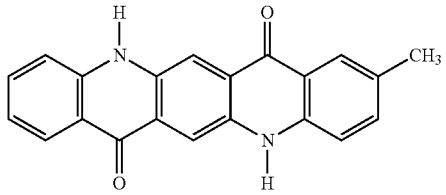

(9)

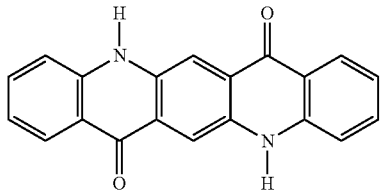

Preparation of Magenta Pigment 2

30 parts of well dried dimethyl succinylo succinate (methyl 1,4-cyclohexandione-2,5-dicarboxylate), 5.6 parts of aniline, 23.6 parts of p-toluidine, 300 parts of methanol and 0.9 part of hydrochloric acid (35%) are placed in an autoclave as a pressure-resistant reactor. The autoclave is sealed and flashed with nitrogen gas, and the pressure is set at a gauge pressure of 0 kg/cm$^2$. While the mixture is vigorously stirred, the temperature thereof is increased from room temperature to 90° C. over 15 minutes, and the mixture is reacted for 5 hours. The reaction mixture is cooled to 30° C. or less, and the pressure is lowered to the atmospheric pressure. 40 g of a sodium hydroxide solution (50%) and 34.6 parts of sodium m-nitrobenzenesulfonate are added to the autoclave, which is then sealed. The mixture is stirred for 10 minutes, and the temperature inside the autoclave is increased from room temperature to 90° C. over 15 minutes. The mixture is then reacted for 5 hours, and the reaction mixture is cooled to 30° C. or less and filtered to remove the solid matters completely. The remaining solution is heated to a temperature of from 30 to 40° C. under stirring. 18 parts of hydrochloric acid (35%) is added dropwise thereto, and the mixture is maintained at that temperature for 30 minutes. Thereafter, the mixture is filtered, and the resulting filtered cake is rinsed with a mixture of water and methanol (1/1) and cold water and then dried to provide 48 parts of a product, which contains the compounds (4), (5) and (6) at a ratio of 73/26/1 as confirmed from the relative peak area ratio measured by HPLC.

250 parts of polyphosphoric acid containing $P_2O_5$ (85.0%) is weighed in a stirring vessel. 45 parts of the product obtained above is added thereto at 90° C. under stirring, and the mixture is heated to 125° C. for 3 hours to perform ring closure reaction. The mixture is cooled to 110° C., to which 6 parts of water is added gradually over 10 minutes. Thereafter, the mixture is poured into 750 parts of water at 50° C., and stirred at 60° C. for 1.5 hours. The solid matter is collected by filtering, and rinsed with water until the rinsing water becomes neutral. 100 parts of the resulting pressed cake is slurried again with 150 parts of ethanol, 15 parts of a sodium hydroxide solution (50%) and a surfactant (C-33, coco alkyl quaternary ammonium salt, 33% solution), and the slurry is heated to approximately 120° C. for 5 hours in a pressure-resistant reactor. The mixture is cooled, and the solid matter is collected by filtering and then rinsed with water. The resulting wet pressed cake is dried in an oven at 80° C., and approximately 19 parts of a solid solution is obtained, which contains the compounds (7), (8) and (9) at a ratio of 70/29/1 as confirmed from the relative peak area ratio measured by HPLC.

Preparation of Magenta Pigment 3

30 parts of well dried dimethyl succinylo succinate (methyl 1,4-cyclohexandione-2,5-dicarboxylate), 20.0 parts of aniline, 15.3 parts of p-toluidine, 300 parts of methanol and 0.9 part of hydrochloric acid (35%) are placed in an autoclave as a pressure-resistant reactor. The autoclave is sealed and flashed with nitrogen gas, and the pressure is set at a gauge pressure of 0 kg/cm$^2$. While the mixture is vigorously stirred, the temperature thereof is increased from room temperature to 90° C. over 15 minutes, and the mixture is reacted for 5 hours. The reaction mixture is cooled to 30° C. or less, and the pressure is lowered to the atmospheric pressure. 40 parts of a sodium hydroxide solution (50%) and 34.6 parts of sodium m-nitrobenzenesulfonate are added to the autoclave, which is then sealed. The mixture is stirred for 10 minutes, and the temperature inside the autoclave is increased from room temperature to 90° C. over 15 minutes. The mixture is then reacted for 5 hours, and the reaction mixture is cooled to 30° C. or less and filtered to remove the solid matters completely. The remaining solution is heated to a temperature of from 30 to 40° C. under stirring. 18 parts of hydrochloric acid (35%) is added dropwise thereto, and the mixture is maintained at that temperature for 30 minutes. Thereafter, the mixture is filtered, and the resulting filtered cake is rinsed with a mixture of water and methanol (1/1) and cold water and then dried to provide 48 parts of a product, which contains the compounds (4), (5) and (6) at a ratio of 20/45/35 as confirmed from the relative peak area ratio measured by HPLC.

250 parts of polyphosphoric acid containing $P_2O_5$ (85.0%) is weighed in a stirring vessel. 45 parts of the product obtained above is added thereto at 90° C. under stirring, and the mixture is heated to 125° C. for 3 hours to perform ring closure reaction. The mixture is cooled to 110° C., to which parts of water is added gradually over 10 minutes. Thereafter, the mixture is poured into 750 parts of water at 50° C., and stirred at 60° C. for 1.5 hours. The solid matter is collected by filtering, and rinsed with water until the rinsing water becomes neutral. 100 parts of the resulting pressed cake is slurried again with 150 parts of ethanol, 15 parts of a sodium hydroxide solution (50%) and a surfactant (C-33, coco alkyl quaternary ammonium salt, 33% solution), and the slurry is heated to approximately 120° C. for 5 hours in a pressure-resistant reactor. The mixture is cooled, and the solid matter is collected by filtering and then rinsed with water. The resulting wet pressed cake is dried in an oven at 80° C., and approximately 19 parts of a solid solution is obtained, which contains the compounds (7), (8) and (9) at a ratio of 20/46/34 as confirmed from the relative peak area ratio measured by HPLC.

Preparation of Pigments 4 to 14

The pigments 4 to 14 are prepared by purchasing from the manufacturers as shown in Table 1 below.

TABLE 1

| | C.I. No. | Manufacturer | Trade name |
|---|---|---|---|
| Pigment 4 | PR 122 | Ciba Specialty Chemicals Co., Ltd. | CROMOPHTAL PINK PT |
| Pigment 5 | PV 19 (γ type) | Ciba Specialty Chemicals Co., Ltd. | PACIFIC RED 2020 |
| Pigment 6 | PR 57:1 | Dainichiseika Colour & Chemicals Mfg. Co., Ltd. | MR-1 |
| Pigment 7 | PR 150 | Fuji Shikiso Co., Ltd. | Fuji Fast Carmine 520 |
| Pigment 8 | PR 48-3 | Fuji Shikiso Co., Ltd. | Fuji Red 5R 763 |
| Pigment 9 | PV 32 | Clariant Japan Co., Ltd. | GRAPHTOL BORDO HF3R |
| Pigment 10 | PR 185 | Clariant Japan Co., Ltd. | NOVOPERM CARM HF4CN VP 502 |
| Pigment 11 | PR 184 | Clariant Japan Co., Ltd. | PERMANENT RUBINE F6B |
| Pigment 12 | PR 146 | Clariant Japan Co., Ltd. | PERMANENT CARMINE FBB02 |
| Pigment 13 | PV 19/PR 254 | Ciba Specialty Chemicals Co., Ltd. | CROMOPHTAL MAGENTA ST |
| Pigment 14 | PV 19 (β type) | Clariant Japan Co., Ltd. | PV FAST VIOLET ER |

Note:
PR: C.I. Pigment Red
PV: C.I. Pigment Violet

Preparation of Pigments 15 to 17

As shown in Table 2 below, commercially available quinacridone pigments are mixed corresponding to the compositional ratios of the dimethylquinacridone and unsubstituted quinacridone in the pigments 1 to 3.

TABLE 2

| | Dimethyl-quinacridone (C.I. PR 122) | Monomethyl-quinacridone | Unsubstituted quinacridone (C.I. No. PV 19) | State of pigment |
|---|---|---|---|---|
| Pigment 1 | 85 | 5 | 10 | solid solution |
| Pigment 2 | 70 | 29 | 1 | solid solution |
| Pigment 3 | 20 | 46 | 34 | solid solution |
| Pigment 4 | 100 | 0 | 0 | single compound |
| Pigment 5 | 0 | 0 | 100 | single compound |
| Pigment 15 | 85 | 0 | 10 | mixture |
| Pigment 16 | 70 | 0 | 1 | mixture |
| Pigment 17 | 20 | 0 | 34 | mixture |

The content ratios of the quinacridone compounds in the pigments are determined by the peak area ratios measured by HPLC under the following conditions.

Measurement Conditions of HPLC

Apparatus: SC-8020, available from Tosoh Corporation

Column: Chomatorex ODS 100A 15 mm, available from Fuji Silysia Chemical, Ltd., 4.6×250 mm, two columns Flow rate: 0.5 mL/min Temperature: 40° C.

Eluant: acetonitrile/water (7/3)

Detector: UV (210 nm)

Preparation of Infrared Ray Absorbent 1

3 parts of N,N,N',N'-tetrakis(p-di(n-butyl)-aminophenyl)-p-phenylenediamine is added to 16.5 parts of DMF (N,N-dimethylformamide) and dissolved by heating to 60° C., to which 1.16 parts of silver nitrate and 2.19 parts of bistrifluoromethanesulfonic imide potassium salt having been dissolved in 16.5 parts of DMF are added, followed by stirring for 30 minutes under heating. After removing insoluble matters by filtering, water is added to the reaction solution, and the crystals thus deposited are filtered, rinsed with water and dried to provide 4.3 parts of an infrared ray absorbent 1 represented by the general formula (1), wherein $R^1$ to $R^8$ each represent a n-butyl group, and X represents $N(CF_3SO_2)_2$ (which may be referred to as an IR agent 1).

Preparation of Infrared Ray Absorbent 2

1.8 parts of N,N,N',N'-tetrakis(p-di(n-butyl)-aminophenyl)-p-phenylenediamine is added to 10 parts of DMF and dissolved by heating to 60° C., to which 1.08 parts of silver trifluoromethanesulfonate having been dissolved in 10 parts of DMF is added, followed by reacting for 30 minutes. After cooling, silver thus deposited is removed by filtering. 20 parts of water is slowly added dropwise to the reaction solution (filtrate), which is stirred for 15 minutes after completing the dropwise addition. The black crystals thus formed are filtered and rinsed with 50 parts of water, and the resulting cake is dried to provide 2.3 parts of an infrared ray absorbent 2 represented by the general formula (1), wherein $R^1$ to $R^8$ each represent a n-butyl group, and X represents $CF_3SO_3$ (which may be referred to as an IR agent 2).

Preparation of Infrared Ray Absorbent 3

1.8 parts of N,N,N',N'-tetrakis(p-di(n-butyl)-aminophenyl)-p-phenylenediamine is added to 10 parts of DMF and dissolved by heating to 60° C., to which 1.00 part of sodium perchlorate having been dissolved in 10 parts of DMF is added, followed by reacting for 30 minutes. After cooling, silver thus deposited is removed by filtering. 20 parts of water is slowly added dropwise to the reaction solution (filtrate), which is stirred for 15 minutes after completing the dropwise addition. The black crystals thus formed are filtered and rinsed with 50 parts of water, and the resulting cake is dried to provide 2.3 parts of an infrared ray absorbent 3 represented by the general formula (1), wherein $R^1$ to $R^8$ each represent a n-butyl group, and X represents a perchlorate ion (which may be referred to as an IR agent 3).

The structures of the infrared ray absorbents 1 to 3 thus obtained are shown in Table 3 below.

TABLE 3

| | General formula (1) | |
|---|---|---|
| | $R^1$ to $R^8$ | $X^-$ |
| Infrared ray absorbent 1 (IR agent 1) | n-butyl group ($—C_4H_9$) | trifluoromethanesulfonic imide ion ($N(CF_3SO_2)_2^-$) |
| Infrared ray absorbent 2 (IR agent 2) | n-butyl group ($—C_4H_9$) | trifluoromethanesulfonate ion ($CF_3SO_3^-$) |
| Infrared ray absorbent 3 (IR agent 3) | n-butyl group ($—C_4H_9$) | perchlorate ion ($ClO_4^-$) |

Preparation of Toner

Examples 1 to 5 and Comparative Examples 1 to 14

In Examples 1 to 5 and Comparative Examples 1 to 14, the materials shown in Table 4 are mixed according to the formulations shown in Table 4. The numerals for the materials in Table 4 denotes the amounts of the materials (part by mass). The resulting mixtures are each melted and kneaded (mixed) with an extruder (PCM-30, available from Ikegai Corporation) at 120° C. and 200 rpm to prepare kneaded products.

The kneaded products are each coarsely pulverized with a hammer mill, finely pulverized with a jet mill and then classified with an air flow classifier, thereby obtaining toner particles having a volume average particle diameter of 4.6 μm for each of Examples and Comparative Examples.

1 part of hydrophobic silica particles (TG820F, available from Cabot Speciality Chemicals, Inc.) are externally added to 98 parts of the toner particles with a Henschel mixer, thereby providing magenta toners for light fixing for Examples 1 to 5 and Comparative Examples 1 to 14.

Preparation of Developer

Two-component developers are produced by using the resulting toners. The carrier to be mixed with the toners is a ferrite carrier having a silicone resin coating with a volume average particle diameter of 30 μm. 95 parts of the carrier is added with 5 parts of each of the toners, and mixed for 2 hours with a 10-L ball mill, thereby preparing developers.

Evaluation

As an image forming apparatus for evaluation, a modified machine of Fuji Xerox 490/980 Continuous Feed equipped with a xenon flash lamp as a light fixing device (the schematic structure of which is in accordance with FIG. 2). The light emission energy of the flash lamp is 5 J/cm$^2$. The paper conveying speed is 1,152 mm/sec.

Evaluation of Fixing Property

Plain paper (NIP-1500LT, available from Kobayashi Create Co., Ltd.) is used as a recording medium, and an image having a dimension of 1 inch square (2.54 cm×2.54 cm) is formed thereon with the image forming apparatus. Specifically, the image is formed in such a manner that the magenta toner for light fixing shown in Table 4 is used, and the amount of the toner attached (i.e., the amount of the toner mounted on the recording medium) is controlled to 0.5 mg/cm$^2$ per single color.

The resulting 1 inch square image is evaluated for fixing property in the following manner.

The status A density (OD1) of the image is measured for each color. Thereafter, an adhesive tape (Scotch Mending Tape, available from Sumitomo 3M Co., Ltd.) is adhered onto the image and then peeled off, and the status A density (OD2) of the image after peeling is measured. The optical density is measured with X-rite 938. The fixing rate is calculated from the values of optical density according to the following expression (2).

$$\text{Fixing rate (\%)}=(OD2/OD1)\times 100 \quad (2)$$

Absorbance of Toner

A sample to be measured is placed in a quartz cell (internal size: 3.4×2.0×4.8 cm) to a height of 4.0 cm. The sample is set in a spectrophotometer and measured under conditions of a measured wavelength range of from 380 to 2,000 nm and a scanning speed of 300 nm/min, and the light absorption intensity at the wavelength is measured by the reflection method. The spectrophotometer used is an ultraviolet and visible spectrophotometer, V-570, available from JASCO Corporation.

TABLE 4

| | Pigment | | | | | | | | | | | | | | | | | Infrared ray absorbent | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | IR agent 1 | IR agent 2 | IR agent 3 |
| Example 1 | 5 | | | | | | | | | | | | | | | | | 1 | | |
| Example 2 | | 5 | | | | | | | | | | | | | | | | 1 | | |
| Example 3 | | | 5 | | | | | | | | | | | | | | | 1 | | |
| Comparative Example 1 | | | | 5 | | | | | | | | | | | | | | 1 | | |
| Comparative Example 2 | | | | | 5 | | | | | | | | | | | | | 1 | | |
| Comparative Example 3 | | | | | | 5 | | | | | | | | | | | | 1 | | |
| Comparative Example 4 | | | | | | | 5 | | | | | | | | | | | 1 | | |
| Comparative Example 5 | | | | | | | | 5 | | | | | | | | | | 1 | | |
| Comparative Example 6 | | | | | | | | | 5 | | | | | | | | | 1 | | |

TABLE 4-continued

| | | | | | | | | | | | | | | |
|---|---|---|---|---|---|---|---|---|---|---|---|---|---|---|
| Comparative Example 7 | | | | | 5 | | | | | | | 1 | | |
| Comparative Example 8 | | | | | | 5 | | | | | | 1 | | |
| Comparative Example 9 | | | | | | | 5 | | | | | 1 | | |
| Comparative Example 10 | | | | | | | | 5 | | | | 1 | | |
| Comparative Example 11 | | | | | | | | | 5 | | | 1 | | |
| Example 4 | 5 | | | | | | | | | | | | 1 | |
| Example 5 | 5 | | | | | | | | | | | | | 1 |
| Comparative Example 12 | | | | | | | | | | 4.75 | | 1 | | |
| Comparative Example 13 | | | | | | | | | | | 3.55 | 1 | | |
| Comparative Example 14 | | | | | | | | | | | | 2.70 1 | | |

| | Binder Polyester | Wax 800P | Fixing assistant WEP 3 | External additive Silica | Evaluation: Absorbance of toner (1,100 nm) | Evaluation: Fixing rate (%) |
|---|---|---|---|---|---|---|
| Example 1 | 90.5 | 2 | 0.5 | 1 | 1.33 | 96 |
| Example 2 | 90.5 | 2 | 0.5 | 1 | 1.36 | 97 |
| Example 3 | 90.5 | 2 | 0.5 | 1 | 1.37 | 98 |
| Comparative Example 1 | 90.5 | 2 | 0.5 | 1 | 1.15 | 85 |
| Comparative Example 2 | 90.5 | 2 | 0.5 | 1 | 1.22 | 88 |
| Comparative Example 3 | 90.5 | 2 | 0.5 | 1 | 1.08 | 82 |
| Comparative Example 4 | 90.5 | 2 | 0.5 | 1 | 1.22 | 88 |
| Comparative Example 5 | 90.5 | 2 | 0.5 | 1 | 1.06 | 81 |
| Comparative Example 6 | 90.5 | 2 | 0.5 | 1 | 0.85 | 72 |
| Comparative Example 7 | 90.5 | 2 | 0.5 | 1 | 1.08 | 82 |
| Comparative Example 8 | 90.5 | 2 | 0.5 | 1 | 1.09 | 82 |
| Comparative Example 9 | 90.5 | 2 | 0.5 | 1 | 1.12 | 84 |
| Comparative Example 10 | 90.5 | 2 | 0.5 | 1 | 1.23 | 89 |
| Comparative Example 11 | 90.5 | 2 | 0.5 | 1 | 0.99 | 78 |
| Example 4 | 90.5 | 2 | 0.5 | 1 | 1.36 | 97 |
| Example 5 | 90.5 | 2 | 0.5 | 1 | 1.27 | 92 |
| Comparative Example 12 | 90.8 | 2 | 0.5 | 1 | 1.19 | 87 |
| Comparative Example 13 | 92.0 | 2 | 0.5 | 1 | 1.22 | 88 |
| Comparative Example 14 | 92.8 | 2 | 0.5 | 1 | 1.24 | 89 |

The components used in Table 4 are as follows.

Binder: binder resin, polyester resin (FP131, a trade name, available from Kao Corporation)

Wax: polypropylene wax (800P, a trade name, available from Sanyo Chemical Industries, Ltd.)

Fixing assistant: ester wax (WEP-3, a trade name, available from NOF Corporation)

External additive: silica (TG820F, a trade name, available from Cabot Speciality Chemicals, Inc.)

It is understood from Table 4 that the images of Examples 1 to 5 formed with the magenta toners containing a monomethylquinacridone provide high light fixing property, and the toners exhibit a high absorbance at a wavelength of 1,100 nm. On the other hand, it is understood from Table 4 that the magenta toners of Comparative Examples 1 to 14 containing no monomethylquinacridone provide images with light fixing property that is inferior to that in Examples, and the toners exhibit a low absorbance at a wavelength of 1,100 nm. Furthermore, it is also understood that even when an unsubstituted quinacridone and a dimethylquinacridone are mixed, and the mixing ratio thereof is controlled, only poor fixing property is obtained when a monomethylquinacridone is not contained. It is understood from the results of Examples and Comparative Examples that a magenta toner containing a monomethylquinacridone provides high light fixing property as compared to a magenta toner containing no monomethylquinacridone.

It is understood from comparison among Examples 1 to 3 that Example 2 where the content of a monomethylquinacridone in the pigment is 29% is superior in light fixing property to Example 1 where the content is 5%, and Example 3 where the content is 46% shows particularly good fixing property among Examples 1 to 3.

It is understood from comparison between Examples 1 to 4 and Example 5 that good fixing property is obtained in the case where $X^-$ in the general formula (1) for the infrared ray absorbent is a trifluoromethanesulfonate ion or a trifluoromethanesulfonic imide ion.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A magenta toner for light fixing comprising:

a binder resin;

at least one selected from a diimonium compound represented by the following general formula (1) and an aminium compound represented by the following general formula (2); and a monomethylquinacridone:

(1)

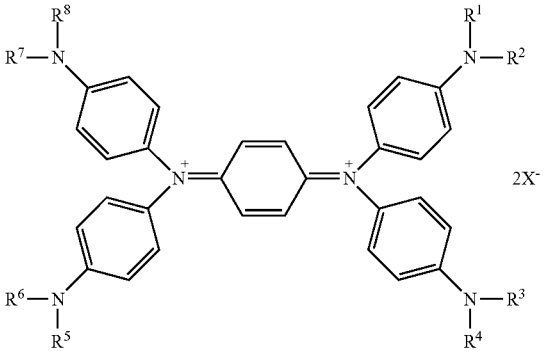

(2)

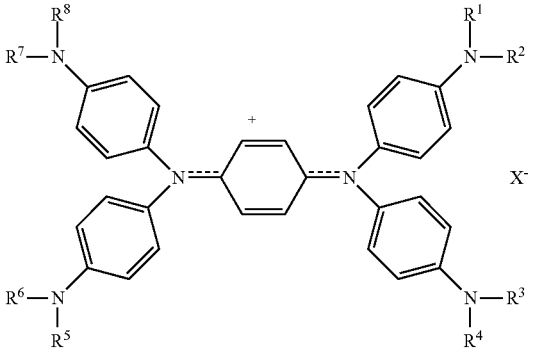

where in the general formulae (1) and (2), $R^1$, $R^2$, $R^3$, $R^4$, $R^5$, $R^6$, $R^7$ and $R^8$ each independently represent a hydrogen atom, an unsubstituted or substituted and linear alkyl group, an unsubstituted or substituted and branched alkyl group, an unsubstituted or substituted and cyclic alkyl group, an unsubstituted or substituted and linear alkenyl group, an unsubstituted or substituted and branched alkenyl group, an unsubstituted or substituted and cyclic alkenyl group, or an unsubstituted or substituted aralkyl group; and $X^-$ represents an anion, wherein a ratio by mass of the at least one selected from the diimonium compound and the aminium compound to the monomethylquinacridone is from approximately 5/3 to approximately 1/70.

2. The magenta toner for light fixing according to claim 1, wherein the monomethylquinacridone has the following structural formula (1):

(1)

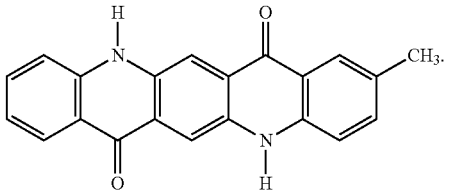

3. The magenta toner for light fixing according to claim 2, wherein the monomethylquinacridone is a compound of structural formula (1) and is contained in a solid solution, the solid solution further containing compounds of structural formulae (2) and (3):

(2)

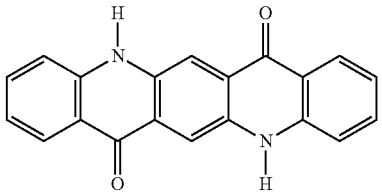

(3)

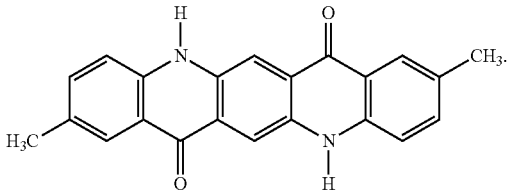

4. The magenta toner for light fixing according to claim 1, wherein a ratio by mass of the at least one selected from the diimonium compound and the aminium compound to the monomethylquinacridone is from approximately 1/1 to approximately 1/5.

5. The magenta toner for light fixing according to claim 3, wherein a content of the monomethylquinacridone in the solid solution containing the monomethylquinacridone, an unsubstituted quinacridone and a dimethylquinacridone is approximately 25% by mass or more.

6. A developer for an electrostatic image, the developer comprising:

a magenta toner for light fixing and a carrier, the magenta toner containing a binder resin;

at least one selected from a diimonium compound represented by the following general formula (1) and an aminium compound represented by the following general formula (2); and a monomethylquinacridone:

(1)

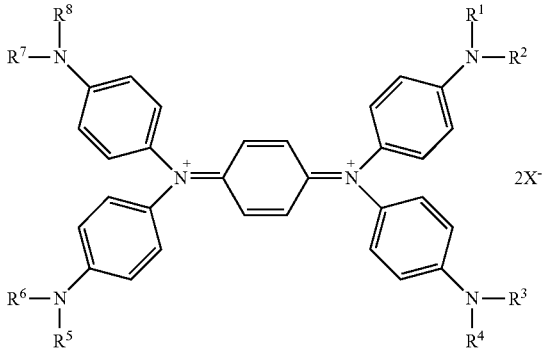

(2)

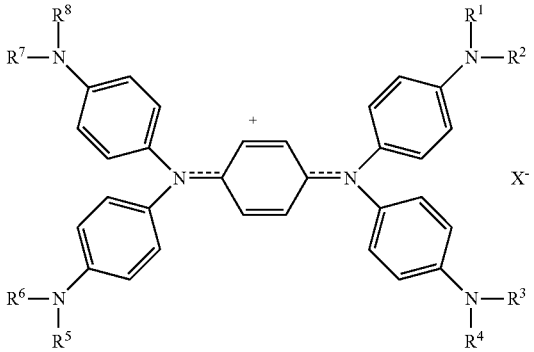

where in the general formulae (1) and (2), $R^1$, $R^2$, $R^3$, $R^4$, $R^5$, $R^6$, $R^7$, and $R^8$ each independently represent a hydrogen atom, an unsubstituted or substituted and linear alkyl group, an unsubstituted or substituted and branched alkyl group, an unsubstituted or substituted and cyclic alkyl group, an unsubstituted or substituted and linear alkenyl group, an unsubstituted or substituted and branched alkenyl group, an unsubstituted or substituted and cyclic alkenyl group, or an unsubstituted or substituted aralkyl group; and $X^-$ represents an anion, wherein a ratio by mass of the at least one selected from the diimonium. compound and the aminiun compound to the monomethylquinacridone is from approximately 5/3 to approximately 1/70.

7. The developer for an electrostatic image according to claim 6, wherein the monomethylquinacridone has the following structural formula (1):

(1)

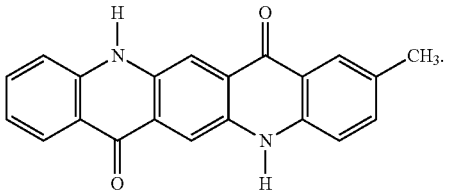

8. The developer for an electrostatic image according to claim 7, wherein the monomethylquinacridone is a compound of structural formula (1) and is contained in a solid solution, the solid solution further containing compounds of structural formulae (2) and (3):

(2)

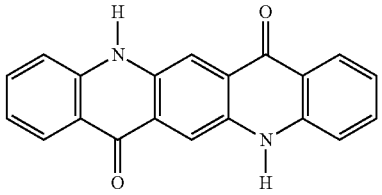

(3)

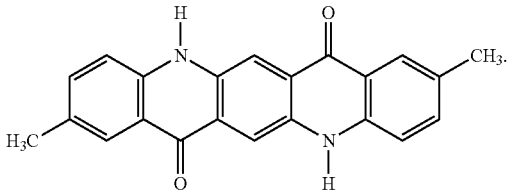

9. The developer for an electrostatic image according to claim 8, wherein a content of the monomethylquinacridone in the solid solution containing the monomethylquinacridone, an unsubstituted quinacridone and a dimethylquinacridone is approximately 25% by mass or more.

10. A developer cartridge containing a developer for an electrostatic image, the developer comprising a magenta toner for light fixing and a carrier, the magenta toner containing:

a binder resin;

at least one selected from a diimonium compound represented by the following general formula (1) and an aminium compound represented by the following general formula (2); and a monomethylquinacridone:

(1)

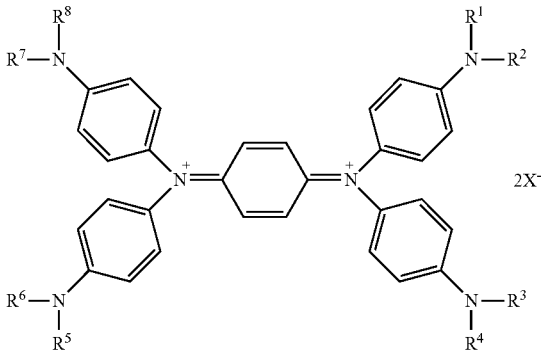

(2)

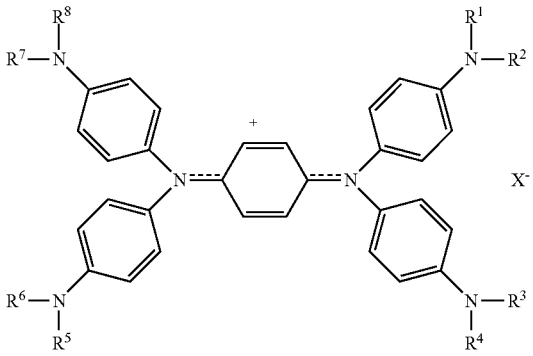

where in the general formulae (1) and (2), $R^1$, $R^2$, $R^3$, $R^4$, $R^5$, $R^6$, $R^7$ and $R^8$ each independently represent a hydrogen atom, an unsubstituted or substituted and linear alkyl group, an unsubstituted or substituted and branched alkyl group, an unsubstituted or substituted and cyclic alkyl group, an unsubstituted or substituted and linear alkenyl group, an unsubstituted or substituted and branched alkenyl group, an unsubstituted or substituted and cyclic alkenyl group, or an unsubstituted or substituted aralkyl group; and $X^-$ represents an anion, wherein a ratio by mass of the at least one selected from the diimonium compound and the aminium compound to the monomethylquinacridone is from approximately 5/3 to approximately 1/70: and the developer cartridge being detachable to an image forming apparatus having a light fixing portion that fixes a toner image on a surface of a recording medium by irradiating light thereto.

11. The developer cartridge according to claim 10, wherein the monomethylquinacridone has the following structural formula (1):

(1)

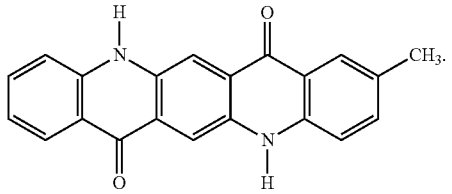

12. The developer cartridge according to claim 11, wherein the monomethylquinacridone is a compound of structural formula (1) and is contained a solid solution, the solid solution further containing compounds of structural formulae (2) and (3):

(2)

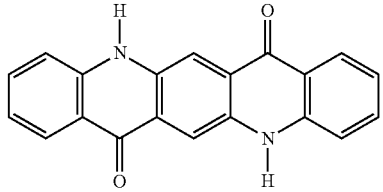

(3)

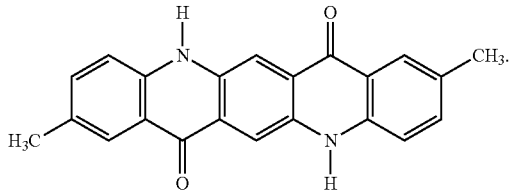

13. The developer cartridge according to claim 12, wherein a content of the monomethylquinacridone in the solid solution containing the monomethylquinacridone, an unsubstituted quinacridone and a dimethylquinacridone is approximately 25% by mass or more.

* * * * *